United States Patent [19]

Hoyt

[11] 4,292,910

[45] Oct. 6, 1981

[54] SPINNAKER POST FOR SAILING VESSEL

[76] Inventor: John G. Hoyt, G.P.O. Box "CN", San Juan, P.R. 00936

[21] Appl. No.: 144,677

[22] Filed: Apr. 28, 1980

[51] Int. Cl.[3] ..... B63H 9/4

[52] U.S. Cl. ..... 114/102

[58] Field of Search ..... 114/102, 39, 108, 98, 114/92, 97, 99; 403/165; 285/276

[56] References Cited

U.S. PATENT DOCUMENTS

| | | | |
|---|---|---|---|
| 383,594 | 5/1888 | Rushton | 114/98 |
| 413,046 | 10/1889 | Gevalt | 114/98 |
| 2,893,339 | 7/1959 | Ram | 114/102 X |
| 3,173,395 | 3/1965 | Laurent | 114/39 |
| 3,294,359 | 12/1966 | Bauer | 285/276 |
| 3,438,349 | 4/1969 | Curtis | 114/102 |
| 3,720,180 | 3/1973 | Strangeland | 114/102 |
| 3,795,216 | 3/1974 | MacPherson | 114/39 |
| 4,044,702 | 8/1977 | Jamieson | 114/39 |

*Primary Examiner*—Trygve M. Blix
*Assistant Examiner*—John C. Paul
*Attorney, Agent, or Firm*—Barlow & Barlow

[57] ABSTRACT

A spinnaker pole arrangement for a sailing vessel is disclosed, (particularly a sailing vessel having a free standing mast) in which a vertical post is mounted ahead of and spaced forward of a mast in the vessel and on top of this post a swivel fitting is included which holds a spinnaker pole. The spinnaker pole may be extended and withdrawn and adjusted through the swivel fitting, and at the end of the pole means are provided to receive spinnaker sheets and/or guys together with fastener means to attach the tack and clew of the spinnaker thereto, the head of the spinnaker being hoisted to the top of the mast by a suitable halyard.

4 Claims, 3 Drawing Figures

SPINNAKER POST FOR SAILING VESSEL

BACKGROUND OF THE INVENTION

In sailing vessels it is usual to utilize a spinnaker for reaching and sailing down wind. A spinnaker is a triangular sail that is defined by a head with a balloon-shaped body and a clew and a tack forming the other two corners. To set this sail, a spinnaker pole is utilized, the spinnaker pole being swivably mounted to the mast and extending outwardly therefrom to be fastened to the tack corner of the spinnaker. The clew, having a sheet attached thereto, is normally led aft and the pole having a guy attached thereto, is also led aft so that between the sheet and the guy the trim of the spinnaker, as it relates to the angle of the apparent wind, may be suitably adjusted. Spinnaker poles of this nature have long been known and are exemplified as, for example, in the Johnson U.S. Pat. No. 358,673 of 1887. This patent also points up the problem that exists particularly for the cruising sailor in that it is difficult to jibe a spinnaker. Basically, while the pivoted pole might work in some situations, it has been found that the best system is raising the inner end of the pole up the mast, detaching the pole from one of the corners of the spinnaker and passing the pole down behind the head stay and re-attaching it on the other side of the vessel. To be sure this is a complicated task, which requires strength, knowledge and agaility and a fairly large crew, if the maneuver is to be completed with smart seamanship. The instant invention solves the problem of handling a spinnaker pole in a vessel, since the spinnaker pole is swivably mounted on deck at all times and it is readily controllable.

SUMMARY OF THE INVENTION

This invention relates to a spinnaker post which is mounted ahead of and spaced forward of a mast in a sailing vessel, the post being adapted to receive a spinnaker pole in a swiveling arrangement. The invention is designed to take the risk, effort and complication out of setting a spinnaker before the mast, jibing the same, and taking the spinnaker down. With the vertical post having the swivel spinnaker pole receptacle atop thereof, the spinnaker pole remains on deck and is totally under control at all times. By virtue of the swiveling action of the spinnaker pole fitting, a variety of lead angles can be obtained, and the spinnaker sail may be jibed without having to detach any of the leads that are attached to the ends of the spinnaker pole.

Therefore, the main object of the invention is to provide a control for a spinnaker pole by providing a vertical post on the deck of a vessel that mounts a rotating head which receives the spinnaker pole and then attach guys and sheets to the pole so that the angle of the pole relative to the vessel may be readily controlled.

DESCRIPTION OF THE PREFERRED EMBODIMENT

Figure 1:
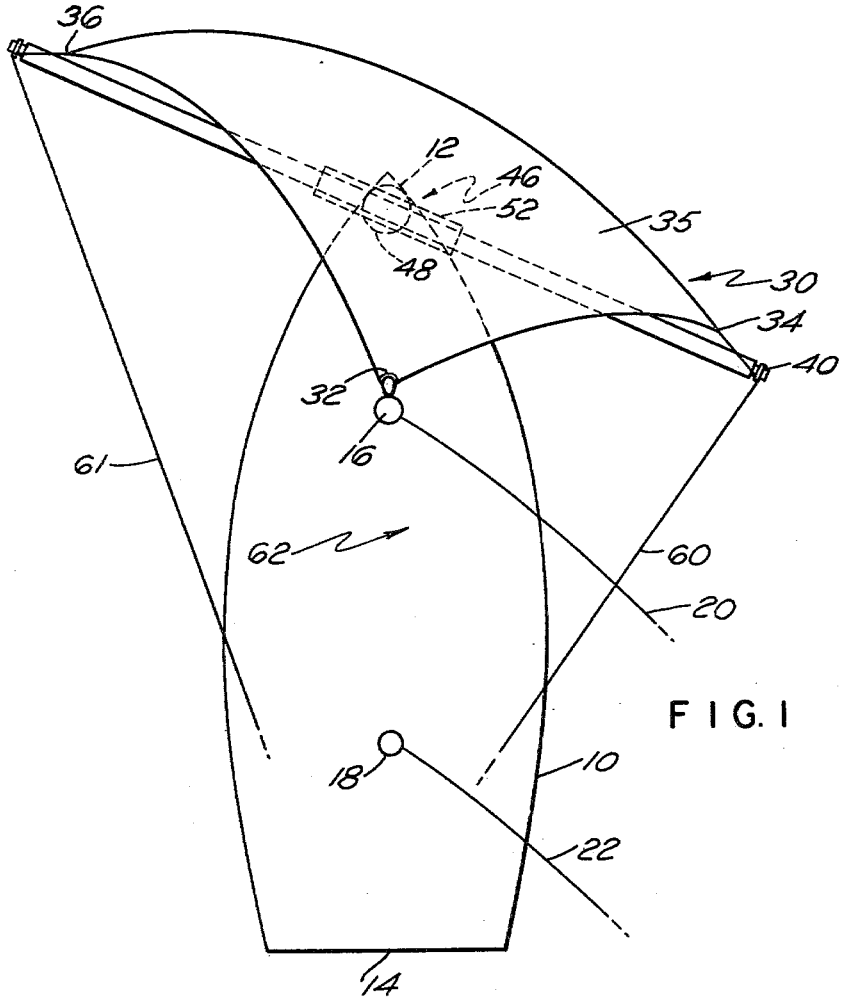
FIG. 1 is a diagrammatic top view of the invention showing its use on a sailing craft.

A vessel generally indicated 10 in the drawings is provided with a bow section 12 and a stern section 14.

In the illustrated form of the drawings, the vessel is shown as having two masts, there being a fore mast 16 and a mizzen mast 18 to which sails 20 and 22 respectively are attached. These sails along the lower edge thereof or foot are normally attached to booms which booms, with suitable sheets that are attached to the hull of the vessel, control the angle of the sail relative to the vessel. In situations where the vessel is in a reaching condition as shown in FIG. 1, which is a diagrammatic view of the sails, it is useful to utilize a spinnaker which is a three-cornered sail with considerable fullness. In the drawings the spinnaker is designated generally 30 and is basically defined by a head portion 32, a clew 34, and a tack 36.

Figure 3:
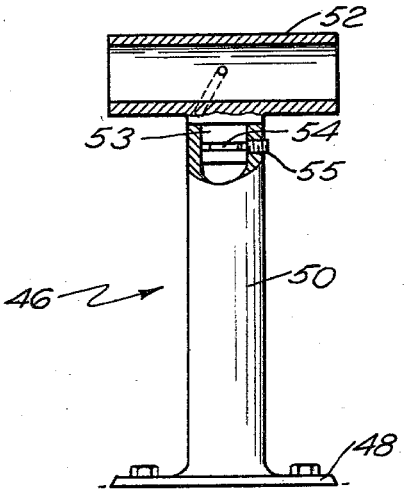
FIG. 3 is an elevational view with parts broken away of the spinnaker post of the invention.
Figure 2:
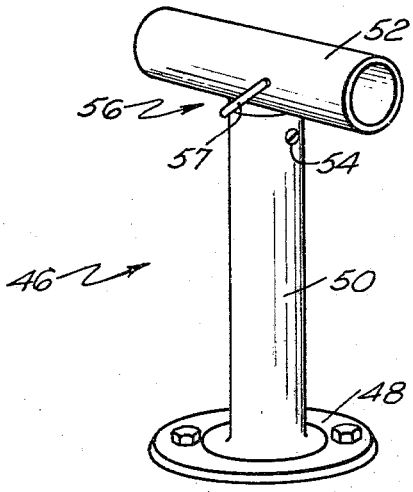
FIG. 2 is a perspective view of the spinnaker post of the invention.

To set a spinnaker, it is necessary to utilize a spinnaker pole which is designated in the drawings 40, which pole is supported on a swivable post means generally designated 46. The swivable post 46 is shown more particularly in FIGS. 2 and 3 and comprises a base 48 and a tubular standard 50. Into the top of the tubular standard 50, a rotating sleeve fitting 52 may be received, the sleeve 52 having a cylindrical stub 53 extending therefrom into the hollow cylindrical post 50 so that the head 52 may rotate relative to the post 50. The stub is held in the post 50 by a set screw 55 that extends into a groove 54. The head 52 is also fitted with a screw clamp 56 having a handle 57 and into this is received the spinnaker pole 40, the head 52 being hollow and illustrated as a cylinder to receive a round section pole.

Referring again to FIG. 1 it will be seen that the spinnaker pole 40 is fitted with a sheet 60 and guy member 61 which is diagrammed as passing into the aft portion 14 of the hull and may be suitably attached to cleats and/or winches and cleats, as the case might be, so that the angle of the spinnaker pole 40 may be varied. It will be apparent that when the spinnaker pole 40 is positioned at the proper angle of the wind, the spinnaker pole effectively becomes a yardarm which holds both tack and clew of the spinnaker that has been hoisted at its head 32 to the top of the mast 16. Inasmuch as the spinnaker pole 40 is free to rotate horizontally, the pole becomes a stabilizing element as well as a device for effectively and easily adjusting the spinnaker to various angles.

As is known in the control and set of spinnaker type sails, the camber of the spinnaker or the amount of fullness thereof may be controlled by the manner in which the foot 35 of the spinnaker is set, that is whether or not the foot extends outwardly or can be stretched tight more or less parallel to the spinnaker pole 40. It will be apparent that the tack and clew 34 and 36 of the spinnaker can be adjusted relative to fittings on the ends of the spinnaker pole 40 to adjust this camber or fullness of the spinnaker. Further, it will become readily apparent that should it be desired to jibe the vessel, the sheet 60 may be unfastened on the hull and the angle thereof readily adjusted by a simple motion to swivel the pole as the vessel is jibed. This is of great assistance as the spinnaker may be readily jibed directly from the aft part of the boat where a cockpit is normally located and there is no need for anyone to go up to the fore part of the vessel as in the case of traditional spinnaker pole arrangements.

It will also be apparent that while the above description has shown a freestanding spar 16, it will also become apparent that the same apparatus can be used with a stayed mast as long as the swiveling spinnaker pole support is located ahead of the jib stay or forestay so that there will not be any impediment to the swiveling action of the spinnaker pole 40. Further, on a two masted vessel, as illustrated, the same structure can be utilized to set a mizzen spinnaker or a mizzen staysail in a more effective manner by mounting the post 46 in the area generally designated 62.

I claim:

1. In a sailing vessel having a hull with a bow and stern sections, a mast mounted to be supported in a general vertical direction from the hull with a substantial area ahead of the mast, that improvement comprising a rigid post forward of and spaced from the mast rigidly fastened to the vessel and rising to a height above the sheer of the hull, a pole, means rotatably secured to the upper end of the post for releasably holding said pole to permit transverse sliding of the pole relative to the post, a triangular sail having head, tack and clew corners, said pole having fittings at each end thereof to which the tack and clew of said sail and suitable sheets or guys may be attached, said sheets and guys leading aft for trimming said pole and said sail and the head of said said being supported by said mast.

2. In a sailing vessel as in claim 1 wherein the means on said post holding said pole comprises a fitting with a clamp means for gripping the pole.

3. In a sailing vessel as in claim 2 wherein the fitting is hollow and of a cross section to be complementary to the section of the pole.

4. In a sailing vessel as in claim 2 wherein the fitting has a cylindrical stub extending into the post to permit rotation relative thereto.

* * * * *